US007857719B2

(12) United States Patent
Giannetti et al.

(10) Patent No.: US 7,857,719 B2
(45) Date of Patent: Dec. 28, 2010

(54) BALL BAT WITH EXPOSED REGION FOR REVEALING DELAMINATION

(75) Inventors: William B. Giannetti, Winnetka, CA (US); Dewey Chauvin, Simi Valley, CA (US); Hsing-Yen Chuang, Studio City, CA (US)

(73) Assignee: Easton Sports, Inc., Van Nuys, CA (US)

( * ) Notice: Subject to any disclaimer, the term of this patent is extended or adjusted under 35 U.S.C. 154(b) by 0 days.

(21) Appl. No.: 11/972,138

(22) Filed: Jan. 10, 2008

(65) Prior Publication Data

US 2009/0181813 A1 Jul. 16, 2009

(51) Int. Cl.
*A63B 59/06* (2006.01)

(52) U.S. Cl. ..... 473/567

(58) Field of Classification Search ..... 473/457, 473/519, 520, 564–568
See application file for complete search history.

(56) References Cited

U.S. PATENT DOCUMENTS

| | | | | |
|---|---|---|---|---|
| 4,014,542 | A | 3/1977 | Tanikawa | |
| 4,025,377 | A | 5/1977 | Tanikawa | |
| 4,505,479 | A | 3/1985 | Souders | |
| 5,303,917 | A * | 4/1994 | Uke | 473/567 |
| 5,397,636 | A * | 3/1995 | Miyao et al. | 428/195.1 |
| 5,415,398 | A | 5/1995 | Eggiman | |
| 5,676,610 | A | 10/1997 | Bhatt et al. | |
| 5,775,800 | A * | 7/1998 | Hsieh | 362/295 |
| 5,861,076 | A * | 1/1999 | Adlam et al. | 156/281 |
| 6,053,828 | A | 4/2000 | Pitsenberger | |
| 6,287,222 | B1 | 9/2001 | Pitsenberger | |
| 6,358,166 | B1 * | 3/2002 | Yu | 473/561 |
| 6,634,969 | B2 | 10/2003 | Forsythe et al. | |
| 6,709,347 | B1 * | 3/2004 | Ono et al. | 473/319 |
| 6,723,127 | B2 | 4/2004 | Ralph et al. | |
| 6,755,757 | B2 | 6/2004 | Sutherland | |
| 6,761,653 | B1 | 7/2004 | Higginbotham et al. | |
| 6,808,464 | B1 | 10/2004 | Nguyen | |
| 6,866,598 | B2 | 3/2005 | Giannetti et al. | |
| 6,997,826 | B2 | 2/2006 | Sutherland | |
| 7,163,475 | B2 | 1/2007 | Giannetti | |
| 2003/0003270 | A1 * | 1/2003 | Wheatley et al. | 428/137 |
| 2007/0189701 | A1 * | 8/2007 | Chakmakjian et al. | 385/146 |

FOREIGN PATENT DOCUMENTS

JP 2001330415 A * 11/2001

* cited by examiner

*Primary Examiner*—Mark S Graham
(74) *Attorney, Agent, or Firm*—Perkins Coie LLP

(57) ABSTRACT

A composite ball bat includes an exposed region of transparent or translucent material, which provides a visual indication of whether delamination has occurred in the ball bat. As a result, an observer can determine, via visual inspection, whether delamination has occurred, and, if it has, can remove the bat from regulated play.

18 Claims, 2 Drawing Sheets

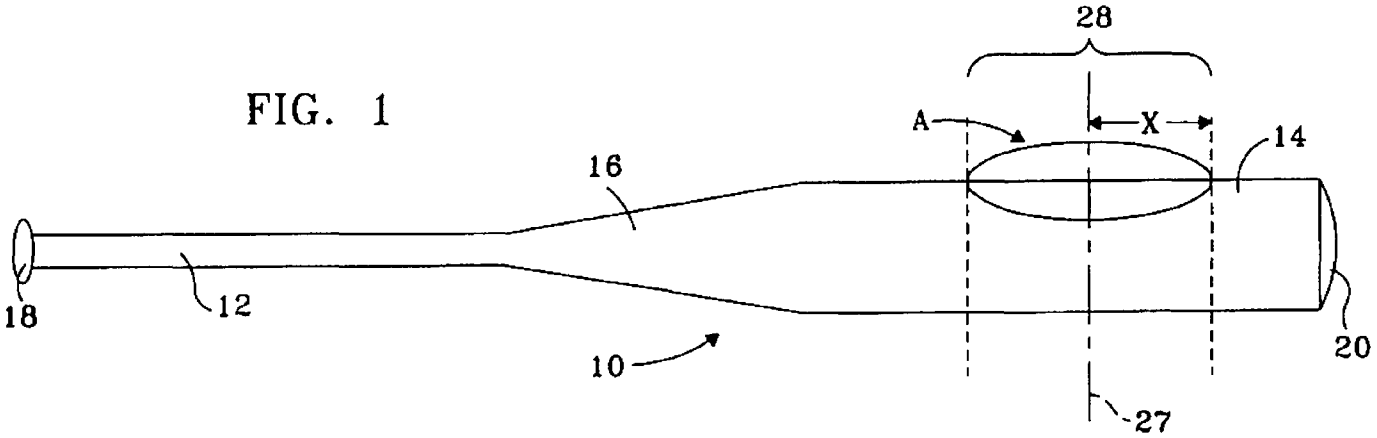
FIG. 1
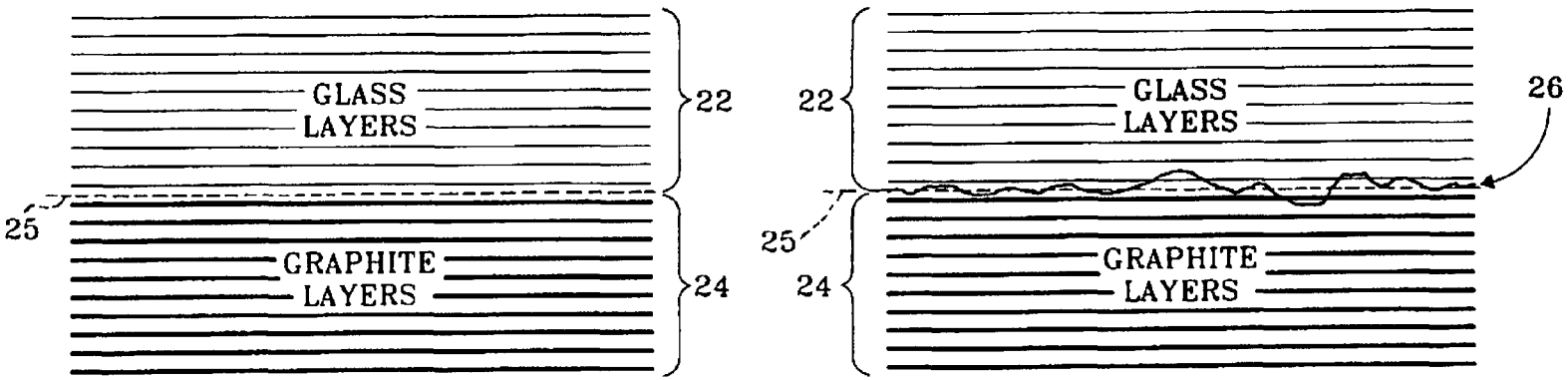
FIG. 2B
FIG. 2A

BALL BAT WITH EXPOSED REGION FOR REVEALING DELAMINATION

BACKGROUND

Exceeding the stress limits of a typical composite ball bat, or other fiber-reinforced composite structure, may allow for an increase in bat performance, in terms of ball exit velocity. This performance increase occurs largely as a result of micro-crack accumulation in the ball bat's resin system, due to a combination of residual stress relief and repeated load application, which results in a slight increase in bat compliance. The amount of the performance increase is generally dependent upon the specific bat design and the materials used to construct the bat.

This performance increase, however, is asymptotic. In other words, as the number of impacts becomes very large, the change in micro-crack density reaches a constant value, such that there is no further performance increase from additional impacts. It is for this reason that a significant number of commercially available composite ball bats are designed to produce a ball exit velocity at least 2 to 4 mph below governing body (e.g., the Amateur Softball Association, or the "ASA") approval limits. In other words, a tolerance of a 2 to 4 mph performance increase, as a result of micro-crack accumulation, is "built into" a typical bat design. In this manner, regardless of the age of the bat structure, the performance limit should not be exceeded under normal use conditions.

As a result of the awareness of this "bat break-in" performance advantage, methods of increased performance acceleration were sought by players trying to gain an increased advantage. These methods have included, but are not limited to, repeatedly hitting a bat against a tree, curb or fencepost, freezing a bat and hitting it with a bowling ball, and putting a bat in a vice and compressing it until the batter hears an audible "pop." All of these techniques severely alter the bat barrel kinetics by breaking down the shear strength between the laminate plies, essentially increasing the number of composite walls present in the structure. The mechanism by which this is achieved is referred to as accelerated break-in ("ABI").

These ABI methods generally do not accelerate micro-crack accumulation (i.e., the natural break-in ("NBI") process), but instead target the weak interlaminar region of the composite structure, which leads to interlaminar fracture or delamination. Delamination is a mode of failure that causes composite layers within a structure to separate, resulting in significantly reduced mechanical toughness of the composite structure. The strength at which a composite structure fails by delamination is commonly referred to as its interlaminar shear strength.

Delamination typically provides significantly increased bat compliance, or increased "trampoline effect," which may result in a ball bat that exceeds association performance limits. Because of this phenomenon, which is not readily detectable, governing bodies are considering enacting stricter compliance limits. These proposed limits could require a ball bat to initially perform well below acceptable association limits, in order to account for the potential performance increase resulting from delamination. As initially constructed, ball bats meeting these increased standards would typically perform poorly and have a bad "feel," thus greatly reducing the desirability of the composite ball bats.

SUMMARY

A ball bat includes an exposed region of transparent or translucent composite material, which provides a visual indication of whether delamination has occurred in the ball bat. Other features and advantages will appear hereinafter.

BRIEF DESCRIPTION OF THE DRAWINGS

In the drawings, wherein the same reference number indicates the same element throughout the several views:

FIG. 1 is a side view of a ball bat, according to one embodiment;

FIG. 2A is a side-sectional view of section A in FIG. 1, prior to delamination.

FIG. 2B is a side-sectional view of section A in FIG. 1, after delamination has occurred.

DETAILED DESCRIPTION

Figure 3A:
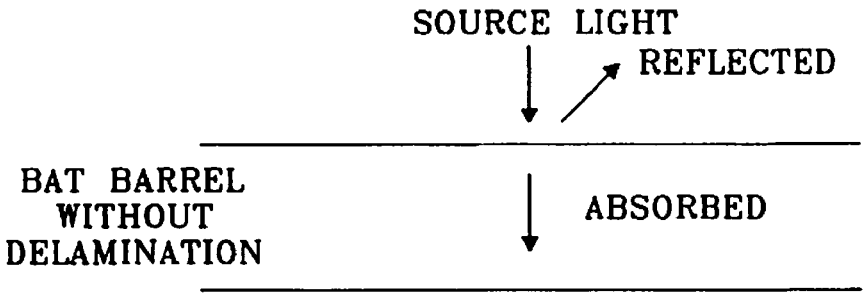
FIG. 3A is a diagrammatic view of source light reflecting from, and being absorbed by, a ball bat in which delamination has not occurred.

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below. Any terminology intended to be interpreted in any restricted manner, however, will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Turning now in detail to the drawings, as shown in FIG. 1, a baseball or softball bat 10, hereinafter collectively referred to as a "ball bat" or "bat," includes a handle 12, a barrel 14, and a tapered section 16 joining the handle 12 to the barrel 14. The free end of the handle 12 includes a knob 18 or similar structure. The barrel 14 is preferably closed off by a suitable cap 20 or plug. The interior of the bat 10 is preferably hollow so that the bat 10 may be relatively lightweight, allowing ball players to generate substantial bat speed when swinging the bat 10. The ball bat 10 may be a one-piece construction or may include a separate handle and barrel, as described, for example, in U.S. Pat. No. 5,593,158, which is incorporated herein by reference.

The ball bat 10 may have any suitable dimensions. The ball bat 10 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the bat 10, and may vary greatly between users.

The ball striking area of the bat 10 typically extends throughout the length of the barrel 14, and may extend partially into the tapered section 16 of the bat 10. For ease of description, this striking area will generally be referred to as the "barrel" throughout the remainder of the description.

The bat barrel 14 may include a single-wall or multi-wall construction. A multi-wall barrel may, for example, include barrel walls that are separated from one another by one or more interface shear control zones ("ISCZs"), as described in detail in U.S. Pat. No. 7,115,054, which is incorporated herein by reference. An ISCZ may include, for example, a disbanding layer or other element or mechanism suitable for preventing transfer of shear stresses between neighboring barrel walls. A disbonding layer or other ISCZ preferably further prevents neighboring barrel walls from bonding to each other during curing of, and throughout the life of, the ball bat 10.

The presence of an ISCZ creates a neutral axis in each neighboring barrel wall, as described in U.S. Pat. No. 6,866,598, which is incorporated herein by reference. The radial location of the neutral axis in each barrel wall varies according to the distribution of the composite layers and the stiffness of the specific layers. The radial components of stress are primarily considered herein, due to their high relative stress ratio (stress/strength) in comparison to any axial stress ratio present. If a barrel wall is made up of homogeneous isotropic layers, the neutral axis will be located at the midpoint of the barrel wall. If more than one composite material is used in a barrel wall, or if the composite material is not uniformly distributed, the neutral axis may reside at a different radial location.

As shown in FIGS. 2A and 2B, in one embodiment, a single-wall bat barrel 14 includes one or more radially outer composite layers 22 or plies reinforced with substantially transparent or translucent fibers, and one or more radially inner composite layers 24 or plies reinforced with substantially opaque fibers. A single-wall barrel 14 may include, for example, multiple glass fiber-reinforced composite layers in a radially outer region of the barrel 14, and multiple graphite fiber-reinforced composite layers in a radially inner region of the barrel 14. The layers are preferably selected and arranged such that the neutral axis of the barrel wall falls substantially at the intersection of the glass and graphite composite layers.

Any other combination of substantially translucent/transparent and opaque fibers may alternatively be used to construct the bat barrel 14. Suitable translucent or transparent fibers include, but are not limited to S-glass, E-glass, R-glass, T-glass, polyethylene, quartz, Astroquartz®, nylon, and rayon fibers. Suitable opaque fibers include, but are not limited to, graphite, boron, zylon®, Twaron®, silicon carbide, and Kevlar® fibers. For ease of description, however, in the following embodiments the translucent or transparent fibers will be referred to as glass fibers, and the opaque fibers will be referred to as graphite fibers.

If extreme stresses are induced in the composite bat barrel 14, such as those produced when the barrel 14 is banged against a hard surface, deflected beyond design limits, or "popped" in a vice, accelerated break-in ("ABI") may occur in the composite layers of the bat barrel 14. ABI generates extremely high interlaminar shear stresses, which often cause delamination of two or more composite layers in the ball bat 10, as illustrated in FIG. 2B. In the absence of other stress-concentrating features, the delamination interface 26 typically occurs at or near the radial neutral axis of the barrel wall because shear stress is generally highest at the neutral axis (assuming no significant anomalies are present in the composite layers). The general barrel region in which delamination occurs will be referred to herein as the delamination zone 28.

In the embodiment illustrated in FIGS. 2A and 2B, the neutral axis 25 is located where the glass and graphite regions meet, although its location may vary depending on the material properties and relative thicknesses of the glass and graphite regions. It is preferable to arrange the glass and graphite regions such that the neutral axis occurs where they meet each other, however, such that ABI causes delamination to occur between the glass and graphite regions. The residual stress brought about by the dissimilar materials at the neutral axis results in a weak interlaminar interface region that is typically not compromised during natural break-in ("NBI"), but becomes compromised during extreme stresses induced by ABI. Moreover, delamination is more readily visually observable at this location due to the high contrast caused by little or no light being reflected from the opaque backdrop provided by the graphite material.

The region of the bat barrel 14 where delamination (and thus, performance increase) is primarily a concern is at or near the point of maximum performance, or the "sweet spot" (the general longitudinal location of which is indicated by line 27 in FIG. 1). This is because performance enhancement in the sweet spot region is most likely to yield a bat capable of performing above association regulatory limits. A delamination zone 28 occurring within a distance X of approximately 3 to 5 inches (in either longitudinal direction) of the sweet spot is generally of greatest concern, although delamination occurring farther from the sweet spot may also lead to unacceptable performance enhancement.

Figure 3B:
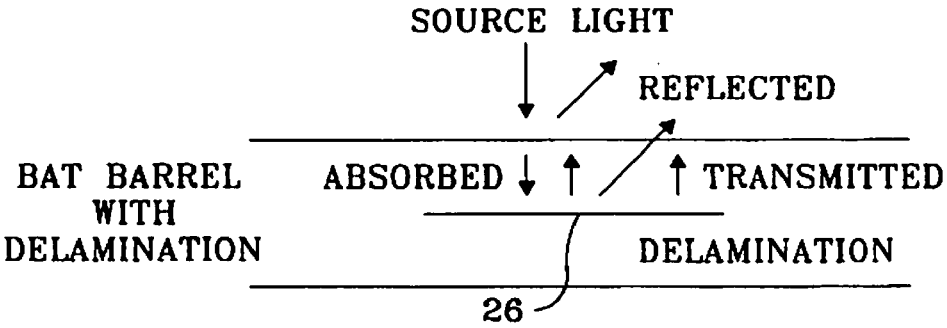
FIG. 3B is a diagrammatic view of source light reflecting from, being absorbed by, and transmitting from a ball bat in which delamination has occurred.

FIGS. 3A and 3B illustrate the effect delamination has on light reflection and transmission in a glass bat barrel. Of note, in a bat barrel 14 that has undergone delamination (FIG. 3B), the index of refraction is generally higher in the delamination zone 28 than in any other region of the ball bat 10. One reason for this phenomenon is that light energy is reflected and transmitted from the delamination interface 26 and, as a result, is reflected at a higher percentage than when delamination is not present. Indeed, when delamination is not present (FIG. 3A), a higher percentage of the light energy is absorbed.

It has been discovered that this discontinuity in the index of refraction in the delamination zone 28 visually appears as a slightly lighter region, which will often be approximately oval in shape. Thus, if the outer glass region of the bat barrel 14 were uncovered or otherwise exposed, a clear differentiation in the delamination zone 28 would be visible to an observer, particularly when the barrel 14 includes an opaque radially inner region as a backdrop.

The barrels of composite ball bats, however, often do not include transparent or translucent materials in their radially outer regions. Furthermore, the radial outer surface of a composite ball bat is typically painted with an opaque paint or otherwise completely covered with graphics, since composite glass is not aesthetically pleasing. This opaque covering layer prevents an observer from viewing any delamination that may be present in the ball bat, regardless of the composite material used in the bat barrel. As a result, delamination typically goes unnoticed in existing composite ball bats. This is problematic, since umpires or other league officials cannot observe when a ball bat has been subjected to ABI or otherwise "doctored" to produce delamination. Accordingly, players are able to manipulate existing composite ball bats to perform above association limits without being detected.

To overcome this problem, the ball bat 10 disclosed herein includes one or more uncovered or otherwise exposed radially outer composite glass barrel regions where delamination may be a concern. In a preferred embodiment, one or more exposed glass regions are located at or near the sweet spot of the barrel, since that is generally the region of primary concern. The one or more exposed glass regions may be of any size or shape suitable to reveal delamination to an observer. For example, an exposed glass region could be relatively small and located at or about the sweet spot, or it could extend the entire length of the barrel (or beyond), or it could be any size in between. In general, the exposed glass region may be any size that substantially reveals the potential delamination zone 28.

The exposed region may include, for example, one or more circumferential bands of glass positioned at or about the sweet spot that are not covered with an opaque paint or other opaque material. Additionally or alternatively, the interior portions of a manufacturer's logo or name may be uncovered by an opaque material, such that the borders of block letters or symbols define one or more exposed glass regions. Any other manner of exposing a potential delamination zone 28 may be used.

In another embodiment, the ball bat 10 may include one or more "message plies" laminated or otherwise positioned within the stack of plies. The message ply may include one or more instances of a word (preferably in a dark ink or other dark coloring), such as "broken," or may include any other indicator that delamination has occurred in the ball bat 10. The message ply is located in the glass region of the barrel 14, preferably within one to six plies of the opaque graphite region. By locating the message ply relatively near the opaque graphite region, the message ply is invisible (or substantially invisible) to an observer before delamination occurs.

When delamination occurs, the message ply becomes visible to an observer due to light reflected from behind the delaminated plies. Thus, the message ply may be used to assist umpires, officials, or players in detecting delamination in the ball bat 10. The message ply is preferably located at or near the sweet spot of the bat barrel 14, and may include multiple messages positioned around the circumference of the ply (such that delamination can be detected in various regions of the barrel 14).

In another embodiment, a single-wall bat barrel 14 primarily includes only composite layers or plies reinforced with substantially transparent or translucent fibers. For example, a substantially all-glass composite barrel 14 may be provided. As in the above embodiment, one or more regions of the outer barrel surface are exposed to reveal one or more potential delamination zones 28 to an observer. In one embodiment, at least one layer of an opaque material, such as graphite, is located between two of the glass layers approximately at the radial neutral axis of the bat barrel 14. The opaque layer provides a solid backdrop, which allows an observer to more readily view any delamination that has occurred in the bat barrel 14.

In another embodiment, the ball bat 10 may include a multi-wall barrel 14 in which the radially neighboring walls are separated by one or more ISCZs. In such a bat, the outer barrel wall (as well as any other barrel walls) may primarily include only transparent or translucent composite materials, such as glass, or may also include radially inner opaque composite materials, such as graphite. Because residual stresses are typically higher in the outer barrel wall in a multi-wall bat, delamination is most likely to occur in the outer barrel wall. Thus, including one or more exposed regions on the outer surface of the radially outer barrel wall allows an observer to view delamination that occurs in that outer barrel wall. Through the use of ISCZs, any desired number of barrel walls may be included in the ball bat 10.

Figure 4:
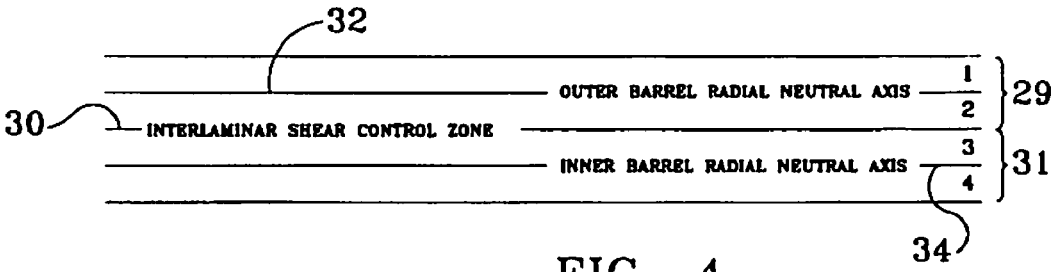
FIG. 4 is a side-sectional view of a multi-wall ball bat barrel including an interlaminar shear control zone.

FIG. 4 illustrates one embodiment of a multi-wall barrel section in which an outer barrel wall 29 is separated from an inner barrel wall 31 by an ISCZ 30. The outer barrel wall 29 and the inner barrel wall 31 each include an outer glass region (Zones 1 and 3, respectively) and an inner graphite region (Zones 2 and 4, respectively), located on opposite sides of a neutral axis 32 and 34, respectively. This construction provides significant compressive strength and durability in the radially outer Zones 1 and 3, and significant tensile strength and stiffness in the radially inner Zones 2 and 4, of the barrel walls 29 and 31. This construction results in a durable bat with exceptional energy transfer capabilities, as described in U.S. Pat. No. 6,866,598.

In any of the above embodiments, the ball bat 10 may be constructed by rolling the various layers of the bat 10 onto a mandrel or similar structure having the desired bat shape. The ends of the layers are preferably "clocked" or offset from one another so that they do not all end in the same location before curing. Accordingly, when heat and pressure are applied to cure the bat 10, the various barrel layers blend together. Put another way, all of the layers of the bat are "co-cured" in a single step, and blend or terminate together at at least one end with no gaps, such that the barrel 14 is not made up of a series of tubes, each with a wall thickness that terminates at the ends of the tubes. As a result, all of the layers act in unison under loading conditions, such as during striking of a ball. While this offset construction is preferred, it is not required. The ball bat 10 may alternatively be constructed in any other suitable manner.

The outer surface of the bat barrel 14 may be painted or otherwise covered with graphics, except of course in the one or more exposed glass regions. As described above, at least one of the exposed regions is preferably located at or near the sweet spot, which is generally the region of primary concern with respect to delamination.

The ball bat 10 may be designed to perform at or just below association limits, since an umpire or game official can visually observe whether delamination has occurred in the ball bat 10. If delamination is observed in a ball bat 10, the umpire or game official can remove the ball bat 10 from competitive play.

Any of the above-described embodiments may be used alone or in combination with one another. Furthermore, the ball bat may include additional features not described herein. While several embodiments have been shown and described, various changes and substitutions may of course be made, without departing from the spirit and scope of the invention. The invention, therefore, should not be limited, except by the following claims and their equivalents.

What is claimed is:

1. A ball bat, comprising:

a barrel comprising a plurality of composite plies, wherein at least a radially outermost ply of the barrel includes translucent or transparent fibers;

a handle connected to or integrated with the barrel;

wherein an exterior region of the radially outermost ply is exposed, thereby allowing an observer to view internal composite plies of the barrel through the exposed region and determine whether delamination of the internal composite plies has occurred;

wherein one of the internal composite plies comprises a message ply that becomes visible through the exposed region only if delamination occurs between barrel plies located radially inwardly from the message ply.

2. The ball bat of claim 1 further comprising opaque graphics on an exterior surface of the radially outermost ply, wherein the graphics are not included on the exposed region.

3. The ball bat of claim 1 wherein the barrel comprises a radially outer region comprising composite plies including glass fibers.

4. The ball bat of claim 3 wherein the barrel comprises a radially inner region comprising composite plies including opaque graphite fibers.

5. The ball bat of claim 4 wherein the radially outer region and the radial inner region are configured such that the radial neutral axis of the bat barrel is located approximately where the radially outer region meets the radially inner region.

6. The ball bat of claim 1 wherein the barrel comprises:

a substantially cylindrical outer wall including a first composite material located radially outwardly from a neutral axis of the outer wall, and a second composite material located radially inwardly from the neutral axis of the outer wall; and a substantially cylindrical inner wall separated from the outer wall by an interface shear control zone, the inner wall including a third composite material located radially outwardly from a neutral axis of the inner wall, and a fourth composite material located radially inwardly from the neutral axis of the inner wall.

7. The ball bat of claim 6 wherein the first and third composite materials each comprise a structural glass.

8. The ball bat of claim 6 wherein the second and fourth composite materials each comprise graphite.

9. The ball bat of claim 1 wherein the exposed region is embodied in a logo or a word.

10. The ball bat of claim 1 wherein the exposed region comprises at least one circumferential band of the radially outer ply that is not covered by an opaque material.

11. The ball bat of claim 1 wherein the exposed region is located at or near the sweet spot of the barrel.

12. The ball bat of claim 1 wherein the barrel comprises a single-wall construction comprising a plurality of composite plies including glass fibers.

13. The ball bat of claim 12 further comprising at least one opaque ply located approximately at the radial neutral axis of the single-wall barrel.

14. A ball bat, comprising:

a composite barrel comprising a plurality of layers, wherein a radially outer region of the barrel comprises a translucent or transparent material, and wherein at least one region of an outer surface of the barrel is not covered by an opaque material;

a handle connected to or integrated with the barrel; and a message ply contained within an internal portion of the radially outer region, wherein the message ply becomes visible through the uncovered region only if delamination occurs between barrel layers located radially inwardly from the message ply.

15. The ball bat of claim 14 further comprising opaque graphics on the outer surface of the barrel, wherein the graphics are not included on the uncovered region.

16. The ball bat of claim 14 wherein the radially outer region comprises composite glass.

17. The ball bat of claim 16 wherein the barrel further comprises a radially inner region comprising composite graphite.

18. A ball bat, comprising:

a composite barrel, wherein at least a radially outermost region of the barrel comprises a translucent or transparent material;

a handle connected to or integrated with the barrel;

a message ply within the barrel that becomes visible only if delamination has occurred radially inwardly from the message ply.

* * * * *